US008186729B2

(12) United States Patent
Dudley

(10) Patent No.: US 8,186,729 B2
(45) Date of Patent: May 29, 2012

(54) TRAPLOCK FOR BI-SWING GATE

(76) Inventor: David Dudley, San Jose, CA (US)

( * ) Notice: Subject to any disclaimer, the term of this patent is extended or adjusted under 35 U.S.C. 154(b) by 138 days.

(21) Appl. No.: 12/236,592

(22) Filed: Sep. 24, 2008

(65) Prior Publication Data

US 2010/0071425 A1 Mar. 25, 2010

(51) Int. Cl.
*E05C 3/06* (2006.01)

(52) U.S. Cl. ... 292/201; 292/144; 292/340; 292/342.17; 292/DIG. 29; 292/DIG. 26; 49/394; 49/326; 49/49; 49/25

(58) Field of Classification Search ..... 292/201, 292/144 X, 145, 146, 340 X, 341.12, 341.13, 292/341.15, 341.16, 342.17 X, DIG. 13, 292/DIG. 19, DIG. 29, DIG. 26, 213, 194 X, 292/304 X; 70/101, 121–123; 49/394 X, 49/326 X, 49 X, 25 X, 32 X
See application file for complete search history.

(56) References Cited

U.S. PATENT DOCUMENTS 4,406,486 A * 9/1983 White ..... 292/144
4,549,369 A * 10/1985 Foley, Jr. ..... 49/279
4,587,695 A * 5/1986 Jensen ..... 24/634
5,476,133 A * 12/1995 Torkelson ..... 160/328
5,492,382 A * 2/1996 McBride et al. ..... 292/341.17
6,010,168 A * 1/2000 Johnson ..... 292/341.17
6,036,245 A * 3/2000 Schaefer ..... 292/341.17

* cited by examiner

*Primary Examiner* — Carlos Lugo
*Assistant Examiner* — Mark Williams
(74) *Attorney, Agent, or Firm* — Richard B. Main

(57) ABSTRACT

A bi-swing gate lock uses an electric actuator to unlatch the gate on request, and a failsafe mode that automatically unlatches the gate during emergencies or power failures. The traplock uses two swing arms that pivot retractable door stops in and out on either side of a closed gate from a stationary 4" post. Loads trying to force open a locked gate are redirected through polyurethane pads on the sides of the retractable door stops directly to the insides of matching pockets within the post. Such loads can flex the swing arms, but significant loads will not reach the swing arm pivot bearings. Keeping the gate locked requires electric power applied to a lock actuator, and the loss of power automatically unlocks the traplock. Power applied to a retraction actuator pushes out the retractable door stops. A sensor detects when the gate returns to a closed position and the lock actuator can be energized once again.

8 Claims, 8 Drawing Sheets

"TRAP" POSITION

"TRAPPING" POSITION

"RETRACTED" POSITION

"LOCKED" POSITION

TRAPLOCK FOR BI-SWING GATE

FIELD OF THE INVENTION

The present invention relates to gate locks, and more particularly to bi-swing gates and electro-mechanical locking systems.

DESCRIPTION OF THE PRIOR ART

Turnstiles and baffle gates used to enforce one-person-per-ticket rules are familiar sights at train and metro stations around the world. But the typical turnstile faregate does not accommodate handicapped persons with wheelchairs or cyclists with bicycles. So some sort of larger sidegate controlled by a station attendant is usually provided.

Prior art sidegates have been a problem to install, operate, and maintain. Some have been expensive to install, and especially to retrofit to older stations and gates. Others use mechanisms that cannot tolerate even normal expected misalignments that occur between the gate and posts. Still others have avoided bi-swing gates because of the difficulty in latching both ways.

One constant problem has been vandalism, in which the gates are forced open. The prior art has used mechanisms that are easily damaged and expensive to repair. What is needed is a swing-gate latch that is rugged, reliable, easy to install, and inexpensive to manufacture.

SUMMARY OF THE INVENTION

Briefly, a bi-swing gate lock embodiment of the present invention uses an electric actuator to unlatch the gate on request, and a failsafe mode that automatically unlatches the gate during emergencies or power failures. The traplock uses two swing arms that pivot retractable door stops in and out on either side of a closed gate from a stationary 4" post. Loads trying to force open a locked gate are redirected through polyurethane pads on the sides of the retractable door stops directly to the insides of matching pockets within the post. Such loads can flex the swing arms, but significant loads will not reach the swing arm pivot bearings. Keeping the gate locked requires electric power applied to at least a lock actuator, and the loss of power automatically unlocks the traplock and spring pressure pulls in the retractable door stops. A sensor is used to detect when the gate is in its closed and open positions.

An advantage of the present invention is that a bi-swing gate lock is provided that is rugged enough to withstand vandalism attempts.

A further advantage of the present invention is that a gate lock is provided that allows normal misalignments and mismatches between the gate and post.

These and other objects and advantages of the present invention will no doubt become obvious to those of ordinary skill in the art after having read the following detailed description of the preferred embodiments which are illustrated in the drawing figure.

IN THE DRAWINGS

FIGS. 8A-8F show several different perspective views of a traplock embodiment of the present invention in the retracted condition, as occurs when power is lost or the station attendant buzzes someone through;

DETAILED DESCRIPTION OF THE PREFERRED EMBODIMENTS

Figure 1:
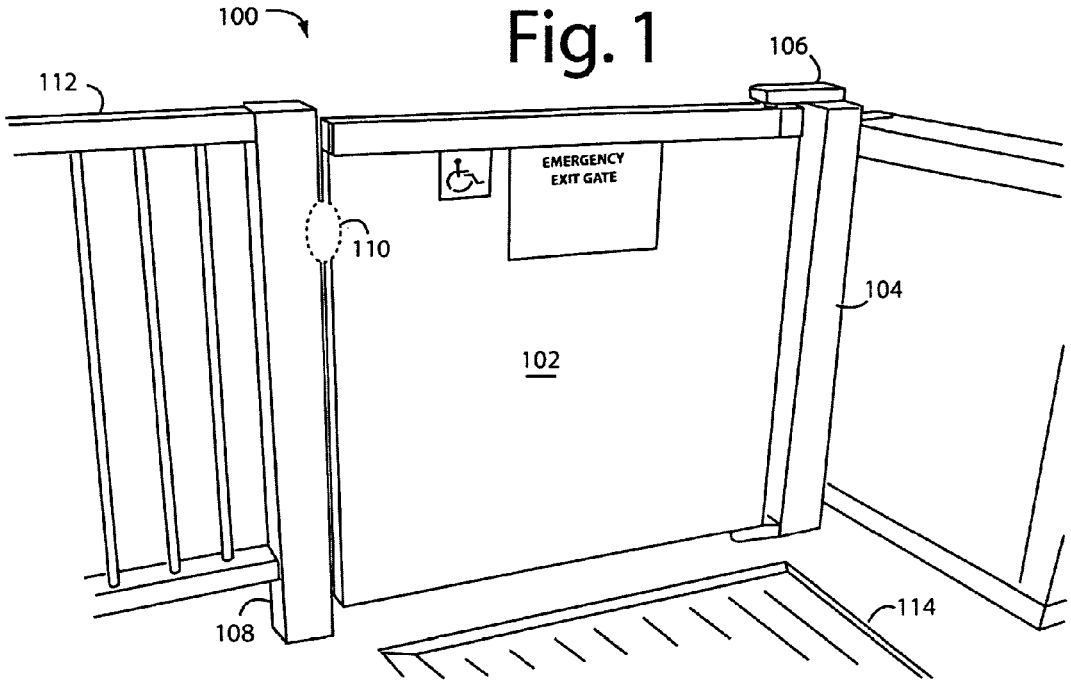
FIG. 1 is a perspective view diagram of a barrier fence and emergency exit gate system embodiment of the present invention as may be used in a train station.

FIG. 1 represents a barrier fence and emergency exit gate system embodiment of the present invention as may be used in a train station, and is referred to herein by the general reference numeral 100. A bi-swing gate 102 can swing in both directions, in and out, on a floor post 104 with hinges 106. It meets another floor post 108 fitted with a traplock 110. A fence section 112 continues off one or both sides. All the major parts are typically constructed of stainless steel. A floor mat switch 114 senses when a person should be allowed access through the gate 102, and its activation unlocks traplock 110.

Figure 2:
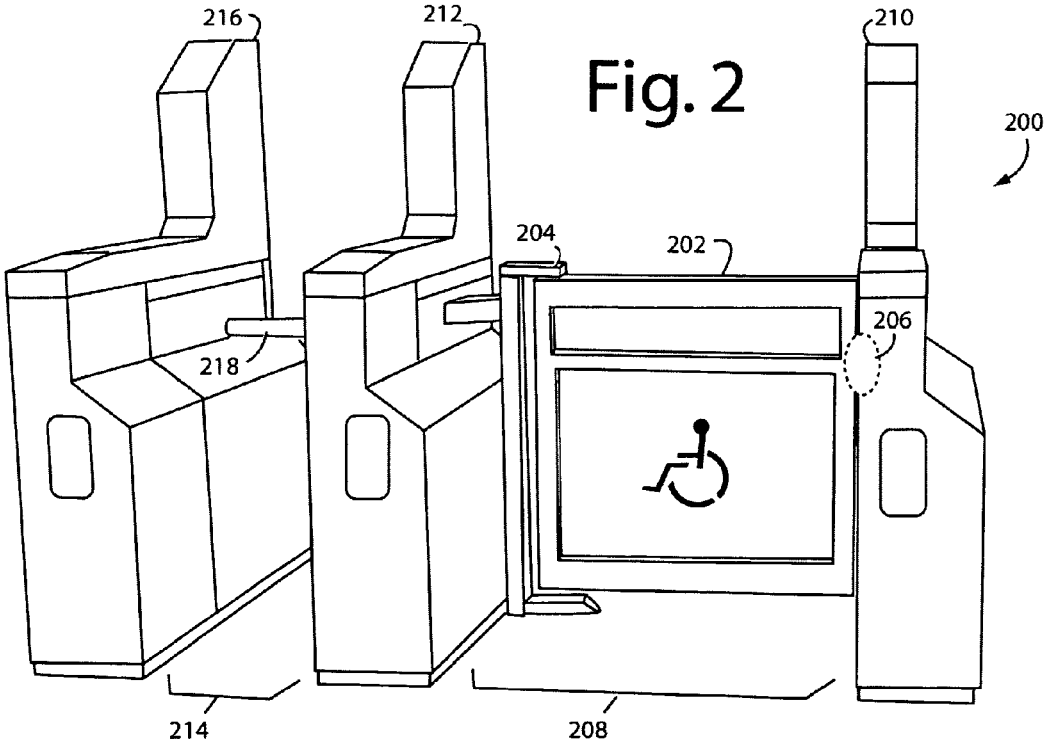
FIG. 2 is a perspective view diagram of a turnstile system embodiment of the present invention that can accommodate ambulatory and handicapped persons in wheelchairs in a train station faregate.

FIG. 2 represents a turnstile system embodiment of the present invention that can accommodate both ambulatory persons, and handicapped persons in wheelchairs through a train station faregate or exit, and is referred to herein by the general reference numeral 200. A bi-swing gate 202 is wide enough to provide for through access of full sized wheelchairs. It swings on a hinge 204 and is latched with a traplock 206 spanning aisle 208. Turnstile pedestals 210 and 212 provide gate hinge and latch support, and are fitted with electronic and electro-mechanical control systems to take tickets or tokens. A number of other narrower aisles 214 are provided for walk-through access bounded by, e.g., pedestal 216, and controlled by a turnstile rotating bar 218.

Figure 3:
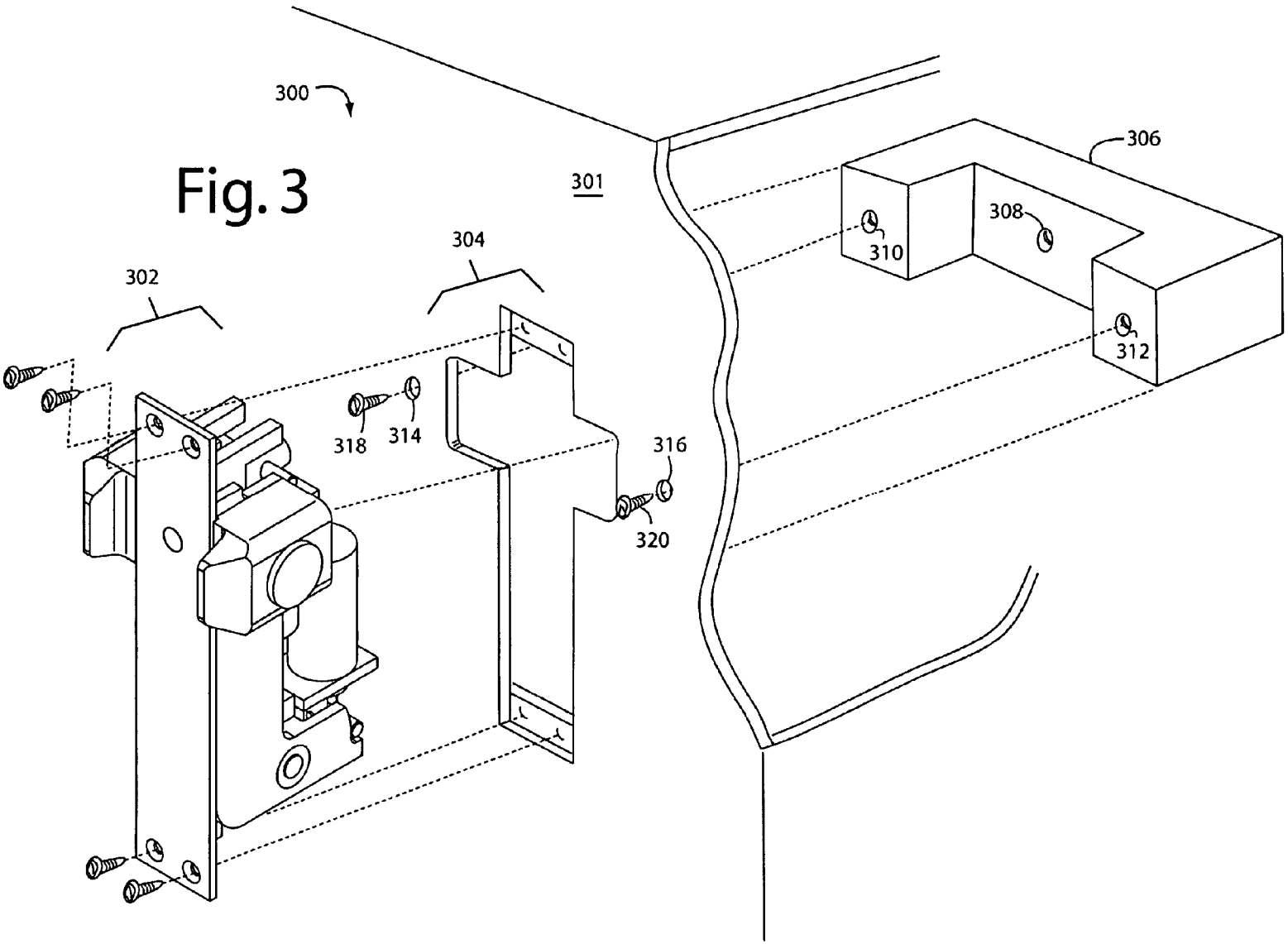
FIG. 3 is a perspective exploded assembly view diagram of a traplock embodiment of the present invention as can be used in the train station faregate of FIG. 2.

FIG. 3 represents a traplock embodiment of the present invention that can be used with gates 102 and 202 in FIGS. 1 and 2, and is referred to herein by the general reference numeral 300. A pedestal panel wall 301 receives a traplock assembly 302 into an opening 304. The configuration of opening 304 can be as original, or if not suitable, then modified from the original on-site and in the field by using sheet-metal punch and dies.

In a preexisting installation being retrofitted, a latch reinforcement 306 is fished through the opening 304 using a fishing tool with a rod attached to a threaded machine screw hole 308. Mounting screw holes 310 and 312 with machine screw taps are aligned with panel holes 314 and 316 to either side of opening 304. Machine screws 318 and 320 are used to then secure the latch reinforcement 306 in place. The fishing tool used to help the installation can then be removed from threaded hole 308. Traplock assembly 302 is electrically connected to a control cable inside panel wall 301, and installed in the pocket using four machine screws.

Figure 4:
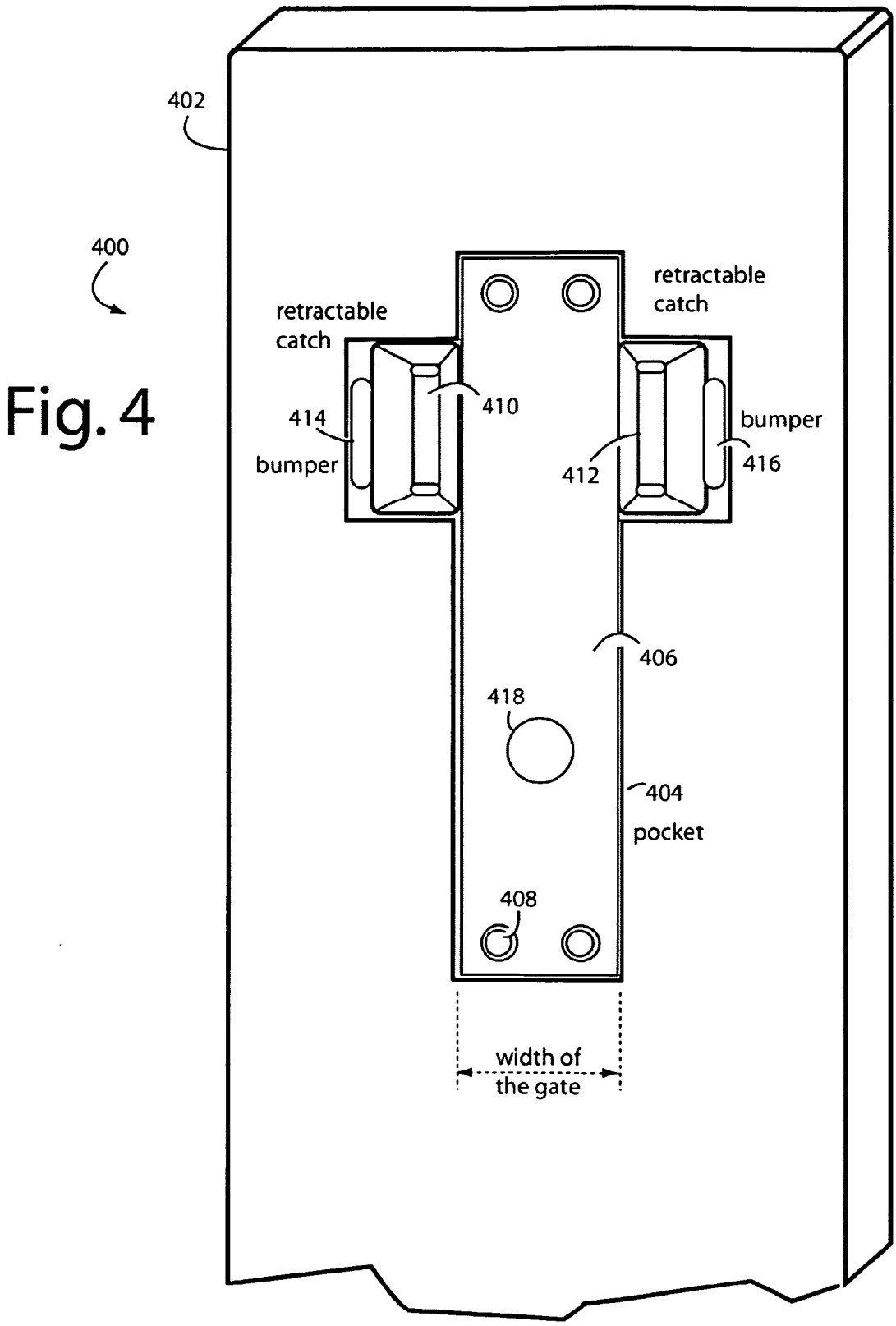
FIG. 4 is a front view diagram of a traplock embodiment of the present invention as can be used in the train station of FIG. 1.

FIG. 4 represents a bi-swing gate latch system 400. The system 400 includes a floor post 402 with a post-mounting pocket 404 for a traplock 406. The traplock 406 is secured within the post 402 and pocket 404 with four fasteners 408. Left and right gate catches 410 and 412 are set apart by the thickness of a matching distal end of a bi-swing gate. When extended, the left and right gate catches 410 and 412 trap the gate in between and lock it in place. Left and right bumpers 414 and 416 are either mounted to the outside surfaces of the left and right gate catches 410 and 412, or to the corresponding points inside the pocket 404. These bumpers 414 and 416 are typically made of hard polyurethane and limit how far the left gate catch 410 can be deflected left, and how far the right gate catch 412 can be deflected right. The central body of traplock 406 limits movements of gates catches 410 and 412 toward the center. A sensor 418 detects when the bi-swing gate is in between the left and right gate catches 410 and 412.

Figure 5A:
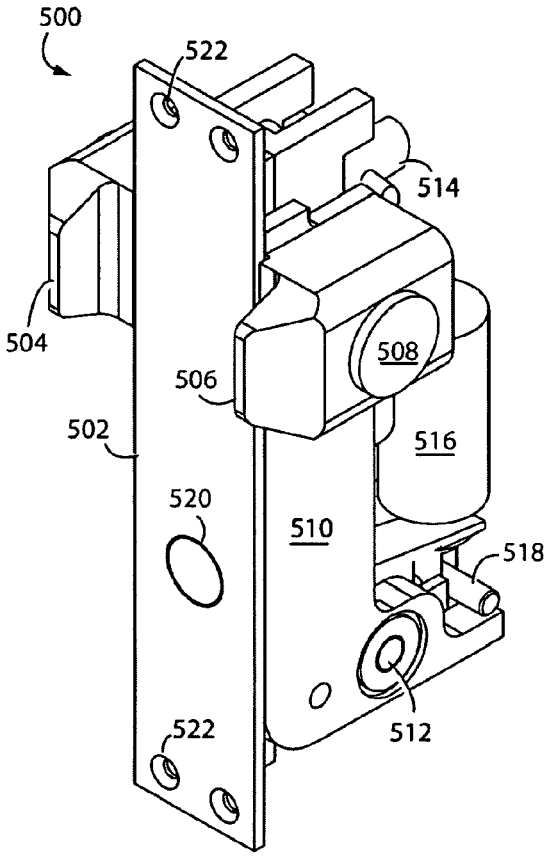
FIGS. 5A and 5B show front and back perspective views of a traplock embodiment of the present invention.
Figure 5B:
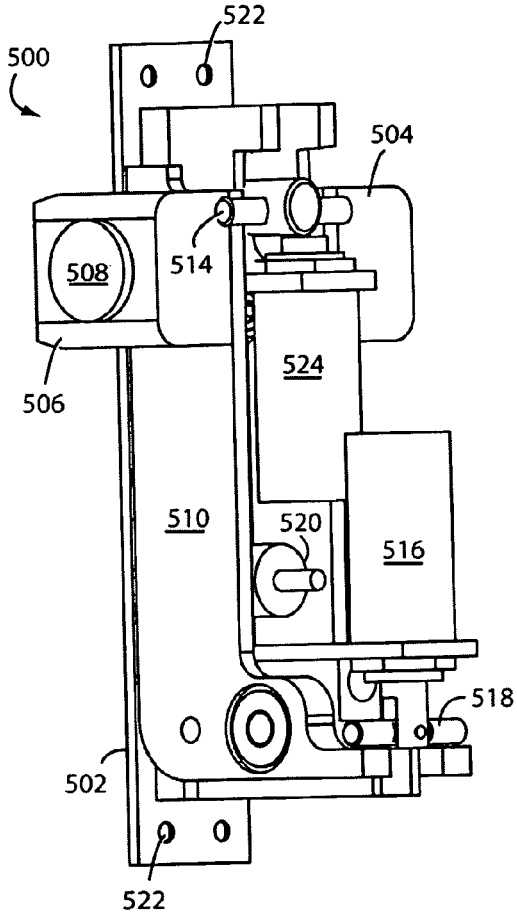
Figure 6A:
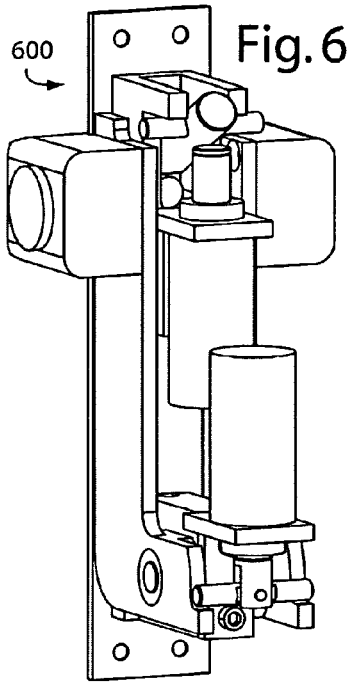
FIGS. 6A-6F show several different perspective views of a traplock embodiment of the present invention in the trap condition, as occurs when the sensor detects the gate is open and is ready to allow it to be closed.
Figure 6B:
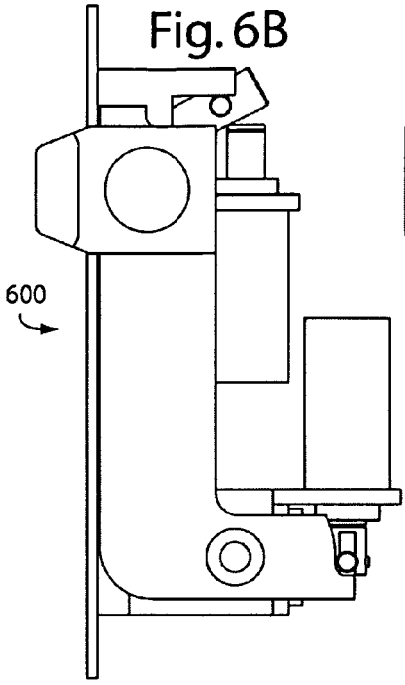
Figure 6C:
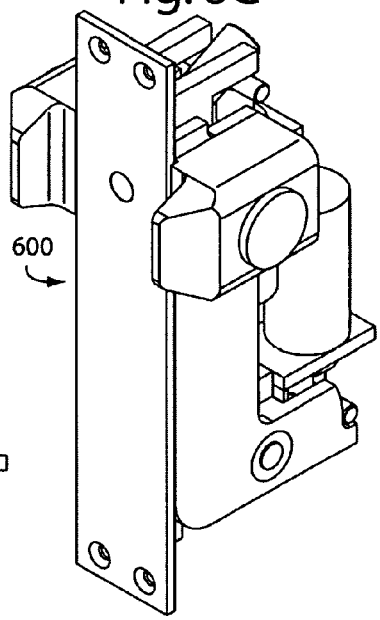
Figure 6D:
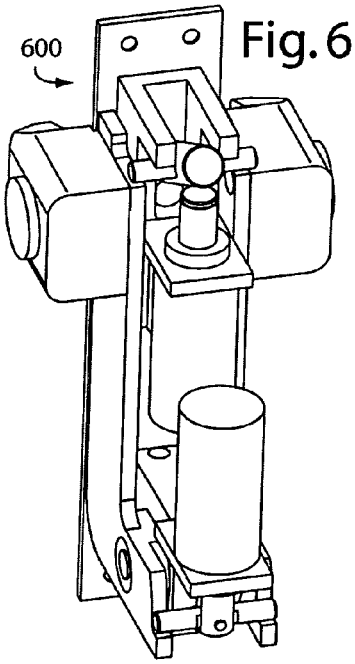
Figure 6E:
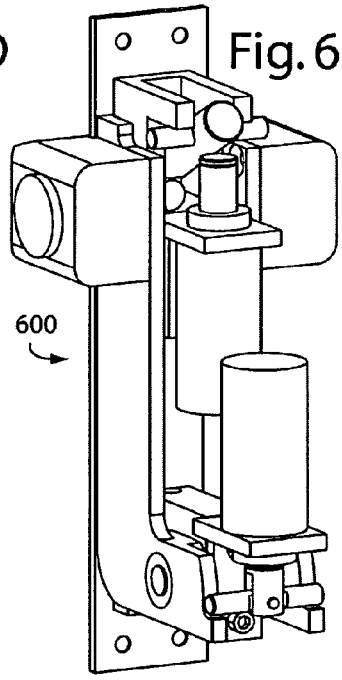
Figure 6F:
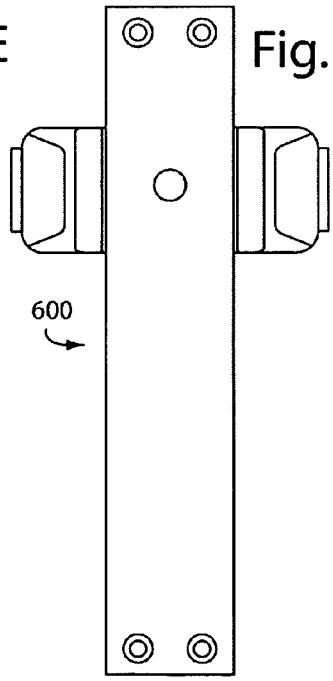
Figure 7A:
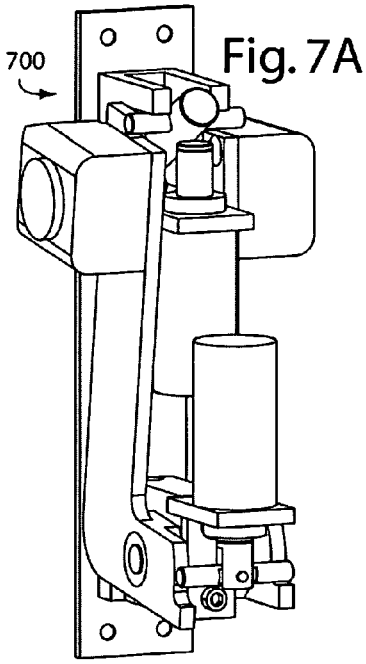
FIGS. 7A-7F show several different perspective views of a traplock embodiment of the present invention in the trapping condition, as occurs when the gate has been open and is now being closed, and the latch has allowed the closing to proceed by letting the gate to push one of the pivots back into its pocket.
Figure 7B:
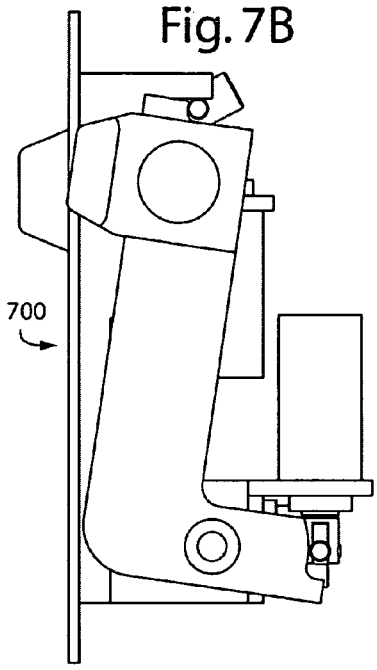
Figure 7C:
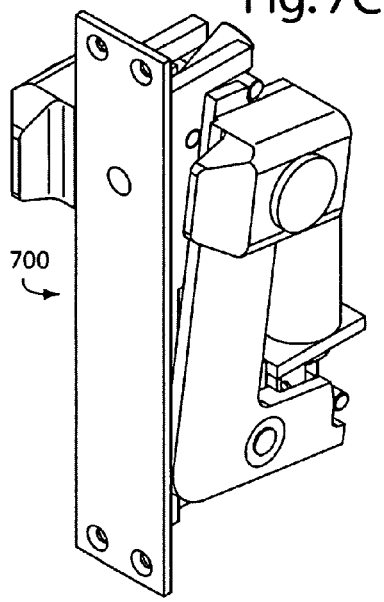
Figure 7D:
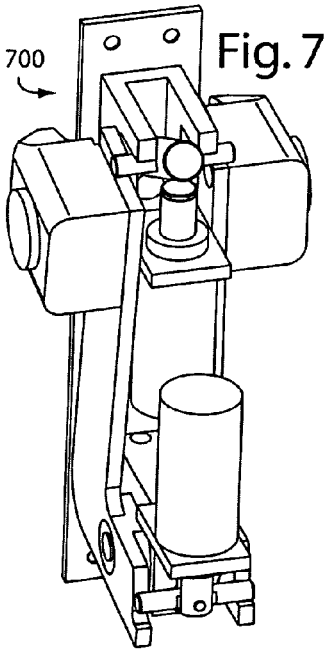
Figure 7E:
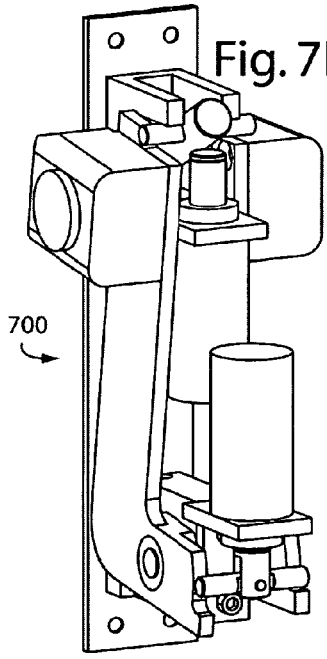
Figure 7F:
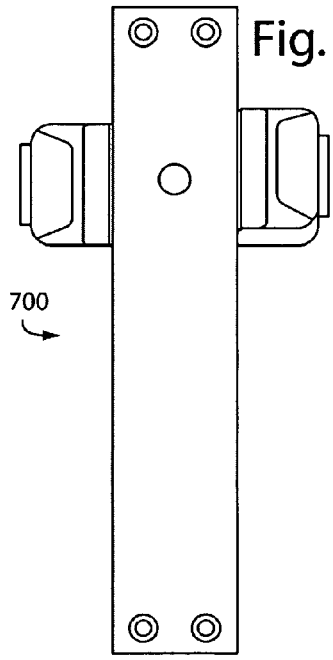
Figure 8A:
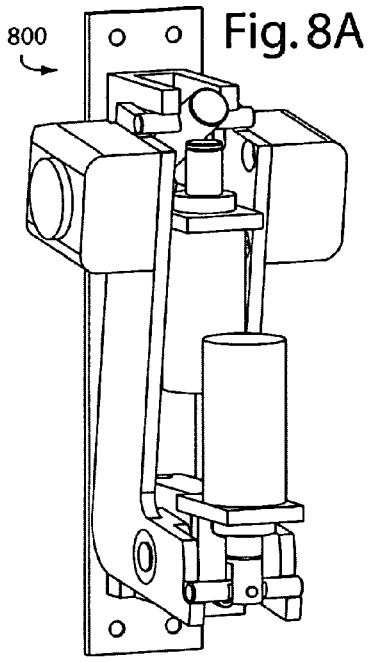
Figure 8B:
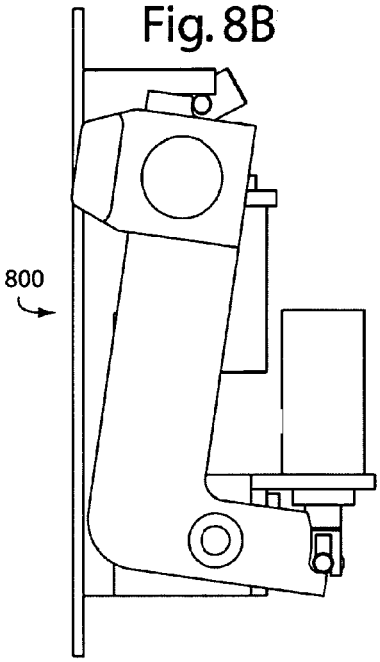
Figure 8C:
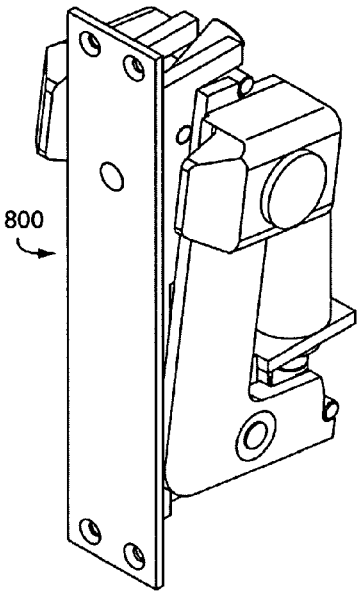
Figure 8D:
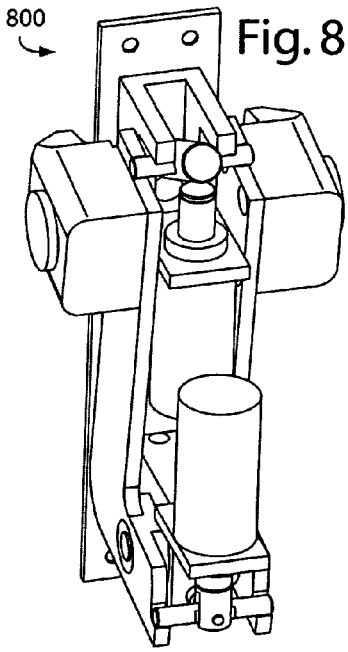
Figure 8E:
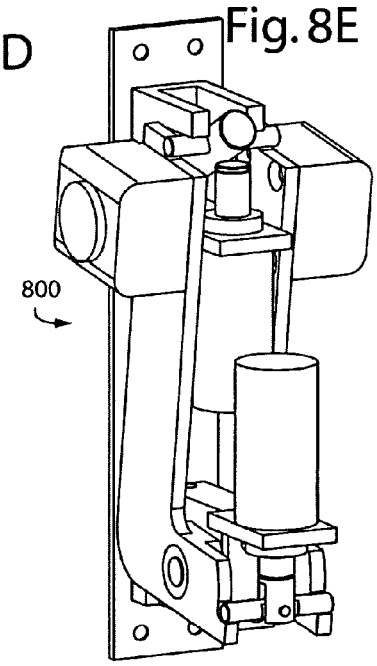
Figure 8F:
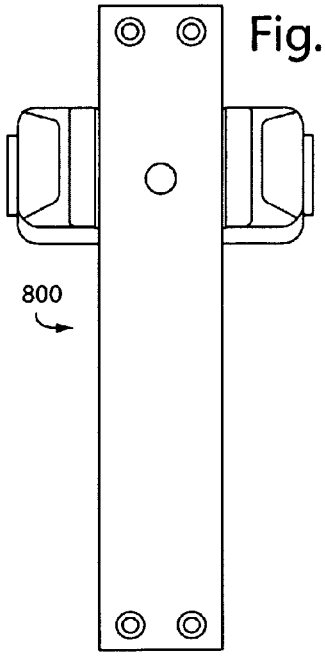
Figure 9A:
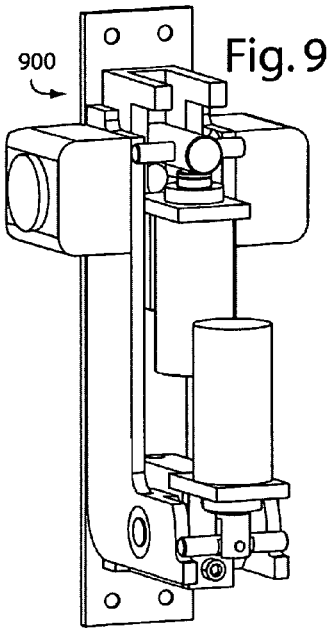
FIGS. 9A-9F show several different perspective views of a traplock embodiment of the present invention in the locked condition, as occurs when power is applied and the sensor detects the gate is fully closed.
Figure 9B:
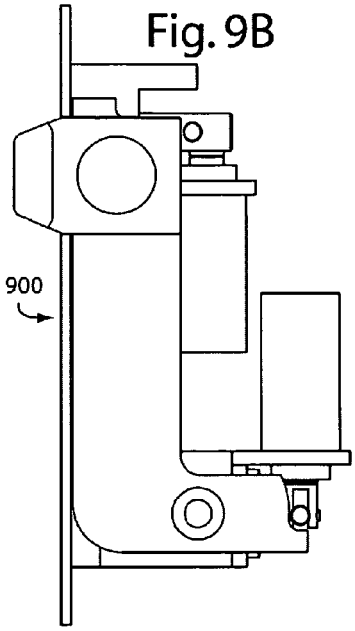
Figure 9C:
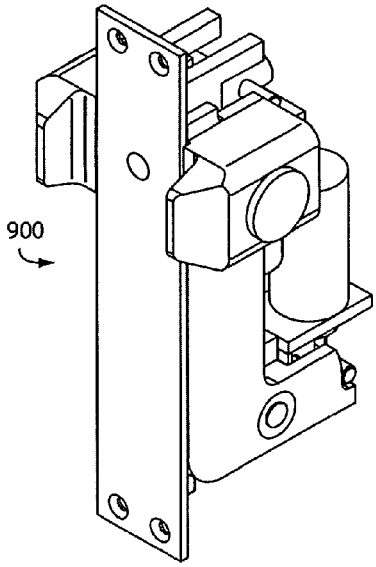
Figure 9D:
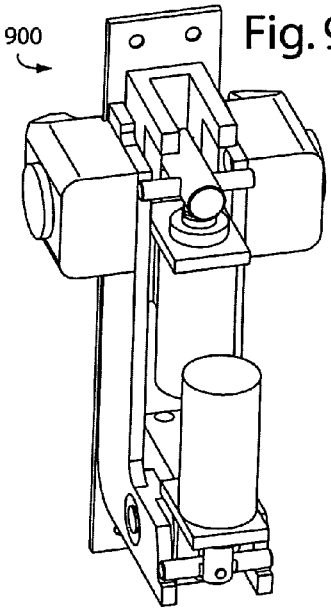
Figure 9E:
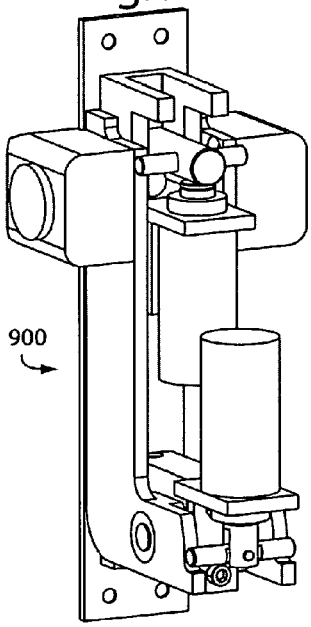
Figure 9F:
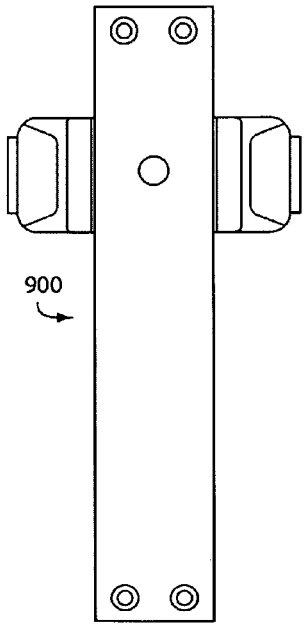

FIGS. 5A and 5B represent a traplock embodiment of the present invention, referred to herein by the general reference numeral 500. Traplock 500 comprises a base plate 502 to which are mounted two pivoting gate catches 504 and 506. Each has a side loading pad, e.g., 508, that controls sideways forces applied to a swing arm 510 on a pivot bearing 512. Another swing arm, not visible in FIGS. 5A-5B carries gate catch 504.

A bi-swing gate, as in FIGS. 1-2, is intended to be trapped between the two gate catches 504 and 506, e.g., when the gate is to be locked closed. The loading pads 508 will be pressed hard against the inside walls of the post if an attempt is made to force the gate open when it is locked closed. In such event, the swing arm 510 will flex a bit to decouple the pivot bearing from damage and press on side loading pad 508, for example.

A locking pawl 514 is shown in FIGS. 5A-5B in the locked position. It traps swing arm 510 such that it cannot retract gate catch 506, for example. Locking pawl 514 is operated by a lock solenoid and spring. The swing arms will move to retract gate catches 504 and 506 when a retraction solenoid 516 relaxes and springs push retraction pawl 518 down. A sensor 520 uses magnetic, proximity, or optical effects to sense when the gate is in its closed position between gate catches 504 and 506. When the gate is closed, it can be locked by locking pawl 514. Four mounting holes 522 are used to secure the traplock 500 in a fence post.

In a lock operation, a lock solenoid pulls the locking pawl 514 down against spring pressure to the position shown in FIGS. 5A-B, and 9A-9F. The unlocked condition will result if electrical operating power is cut to lock solenoid 524, because spring pressure will push locking pawl 514 up, as in FIGS. 6A-6F, 7A-7F, and 8A-8F. Power is thus required to be present to lock and maintain the locked condition of the gate, and is a failsafe feature needed for emergency situations where the station gates must be unlocked to allow people to evacuate.

In a gate-open operation, if the retraction solenoid 516 is relaxed and sensor 520 detects the gate is still closed, spring pressure will push the retraction pawl 518 down against the ends of swing arms 510 to the position shown in FIGS. 8A-8F. Power is thus required to be present to maintain the locked or trapping condition of the gate.

FIGS. 6A-6F represent a traplock 600, in an embodiment of the present invention in the trap condition, as occurs when the sensor detects the gate is open, and the system is ready to allow it to be snapped closed.

FIGS. 7A-7F represent a traplock 700, in an embodiment of the present invention in the trapping condition, as occurs when the gate has been open and is at the point of being closed. The latch on the corresponding side has allowed the closing to proceed by letting the gate to push one of the pivots back into its pocket.

FIGS. 8A-8F represent a traplock 800, in an embodiment of the present invention in the retracted condition, as occurs when power is lost or the station attendant buzzes someone through.

FIGS. 9A-9F represent a traplock 900, in an embodiment of the present invention in the locked condition, as occurs when power is applied and the sensor detects the gate is fully closed.

In general, embodiments of the present invention include a bi-swing gate lock with a pair of gate catches that can be retracted inside to allow a matching bi-swing gate to open in either direction. A pair of pivot arms are included with pivot bearings at one end and the gate catches at the distal ends. A lock solenoid and pawl can lock the gate catches in their extended, gate-locked positions. A sensor is mounted to detect when the bi-swing gate has returned to a closed position, and to allow the lock solenoid and pawl to lock the gate catches in their extended, gate-locked positions. A pad is positioned to the outer sides of the gate catches, and limits how far laterally the gate catches may be deflected when an attempt is made to force open an otherwise locked bi-swing gate.

The pivot arms allow the gate catches to flex outward to absorb the normal shock of closing the gate, and are especially important when an attempt is made to force open an otherwise locked bi-swing gate. In some installations, the inside width of a post is just right to nest the traplock. In other applications, a post-mounting pocket or U-channel is positioned around the outer sides of the gate catches, and the close contact limits how far laterally the gate catches can deflect when an attempt is made to force open an otherwise locked bi-swing gate.

In an alternative embodiment, the gate catches are linearly actuated, and opposed to being swung on the ends of a pivot arm as in FIGS. 1-9F. Such alternative embodiment would require a lot more depth for the final installation, because the flex arm would be straight and connected to an appropriate actuator even deeper behind them. A standard 4" post does not offer enough depth for this variation, and that is why a swinging pivot arm was used in the other embodiments described here. The basic arrangement of placing a door catch on the distal end with a loading pad on its side is retained in the linear arrangement. E.g., so that the arm can flex enough to allow the loading pad to contact the inside walls of the post or other pocket when strong sideways forces are applied.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A bi-swing gate lock, comprising:

a pocket provided inside a face of a post facing a swinging end of a gate;

a pair of gate catches mounted in said pocket and configured to catch and lock said swinging end of said gate between the pair of gate catches when said gate catches are in an extended position, and such that a retraction of either one of the gate catches permits a swing opening of the gate;

a pair of pivot arms, each pivot arm having a pivot bearing at one end about which the pivot arm rotates, and each pivot arm connected to a respective gate catch at an opposite distal end, and fully disposed inside said pocket, wherein each of the pivot arms rotates in a plane substantially parallel to one another and to the plane of said gate when closed;

an actuating mechanism operably connected to each pivot arm configured to maintain the gate catches in the extended position or to move at least one of the gate catches to a retracted position; and each gate catch having a side-loading pad positioned on an outermost side surface of each of said gate catches, each side-loading pad limits lateral deflections of the gate catches within said pocket and resist a forcing open of an otherwise locked gate by transferring a lateral force through a corresponding side-loading pad to an inside lateral wall of said pocket and thereby not allowing a respective pivot arm pivot bearing to be stressed from an attempt to force open the locked gate.

2. The bi-swing gate lock of claim 1, further comprising:

a lock solenoid and pawl for locking the gate catches in extended positions that can capture and hold the gate;

a retraction solenoid and pawl for forcing the pivot arms to swing in and retract the gate catches so the gate may be opened; and a sensor mounted to detect if the gate has returned to a closed position, and to allow the lock solenoid and pawl to lock the gate catches in extended positions.

3. The bi-swing gate lock of claim 1, wherein:

the pivot arms are configured to flex the gate catches laterally toward a respective pocket wall if force is being applied to open an otherwise locked gate.

4. The bi-swing gate lock of claim 1, wherein:

said pocket is sized and positioned relative to the gate catches and side-loading pads to limit how far the gate catches can laterally deflect when in a gate-locked position with the gate between.

5. The bi-swing gate lock of claim 1, further comprising:

an automatic unlocking device configured to unlock said gate catches whenever the lock solenoid and pawl lose operating power.

6. An improved barrier fence and emergency exit gate system, comprising:

a bi-swing gate able to swing in two opposite directions, and mounted on a first floor post by hinges;

a second floor post for closing and latching a swinging end of the bi-swing gate and provided with a pocket;

the improvement characterized by a traplock assembly comprising:

a pair of gate catches mounted in said pocket and configured to catch and lock said swinging end of said gate between the pair of gate catches when said gate catches are in an extended position, and such that a retraction of either one of the gate catches permits a swing opening of the gate;

a pair of pivot arms, each pivot arm having a pivot bearing at one end about which the pivot arm rotates, and each pivot arm connected to a respective gate catch at an opposite distal end, and fully disposed inside said pocket;

a lock solenoid and pawl configured to lock the gate catches in extended positions;

a retraction solenoid and pawl configured to move at least one of the pivot arms to a retracted position such that the gate may be opened;

a sensor mounted to detect when the bi-swing gate has returned to a closed position, and to allow the lock solenoid and pawl to lock the gate catches in extended positions;

each gate catch having a side-loading pad respectively positioned on an outermost side surface of the gate catches, and each side-loading pad limiting how far laterally the gate catches made be deflected when an attempt is made to force open an otherwise locked bi-swing gate;

a post-mounting pocket positioned to the outer sides of the gate catches, and for limiting how far laterally the gate catches can deflect when an attempt is made to force open an otherwise locked bi-swing gate; and a failsafe device for automatically unlocking the gate catches if operating power is cut from the lock solenoid and pawl.

7. The system of claim 6, further comprising:

a floor mat switch to sense when to unlock the traplock assembly.

8. A turnstile system to accommodate ambulatory and handicapped persons in wheelchairs through a train station faregate or exit, comprising:

a bi-swing gate mounted and configured to swing on a gate hinge and that can be latched closed;

a pair of turnstile pedestals to provide support for said gate hinge and support for a latch provided in a pocket, and configured with electronic and electro-mechanical control systems to take tickets or tokens;

an aisle provided for walk-through access bounded by a pedestal and controlled by a turnstile rotating bar;

characterized by a traplock assembly comprising:

a pair of gate catches mounted in said pocket and configured to catch and lock said swinging end of said gate between the pair of gate catches when said gate catches are in an extended position, and such that a retraction of either one of the gate catches permits a swing opening of the bi-swing gate;

a pair of pivot arms, each pivot arm having a pivot bearing at one end about which the pivot arm rotates, and each pivot arm connected to a respective gate catch at an opposite distal end, and fully disposed inside said pocket;

a lock solenoid and pawl configured to lock the gate catches in extended positions;

a retraction solenoid and pawl configured to move at least one of the pivot arms to a retracted position such that the gate may be opened;

a sensor mounted to detect if the bi-swing gate has returned to its closed position, and to enable the lock solenoid and pawl to lock the gate catches in extended positions;

a pad positioned to the outer sides of the gate catches to limit how far laterally the gate catches made be deflected if force is applied to open an otherwise locked bi-swing gate;

a post-mounting pocket positioned to the outer sides of the gate catches, and for limiting how far laterally the gate catches can deflect when an attempt is made to force open an otherwise locked bi-swing gate; and a failsafe device for automatically unlocking the gate catches if operating power is cut from the lock solenoid and pawl.

* * * * *